US006236304B1

(12) United States Patent
Gonsalves

(10) Patent No.: US 6,236,304 B1
(45) Date of Patent: May 22, 2001

(54) WAVE TRANSFER TEACHING AID AND NATIONAL WAVE TRANSFER DEVICE (RAG-1)

(76) Inventor: Robert A. Gonsalves, 16 Lexington St., Woburn, MA (US) 01801

( * ) Notice: Subject to any disclaimer, the term of this patent is extended or adjusted under 35 U.S.C. 154(b) by 0 days.

(21) Appl. No.: 09/388,395

(22) Filed: Sep. 1, 1999

(51) Int. Cl.[7] ..... G08B 5/00

(52) U.S. Cl. ..... 340/332; 340/999

(58) Field of Search ..... 340/999, 815.4, 340/932, 331, 332, 815.69, 815.7; 116/3, 22 R, 201, 202

(56) References Cited

U.S. PATENT DOCUMENTS

| | | | | |
|---|---|---|---|---|
| 4,275,292 | * | 6/1981 | Corbi | 235/92 TC |
| 5,526,479 | * | 6/1996 | Barstow et al. | 395/152 |
| 5,813,865 | * | 9/1998 | Greenbowe et al. | 434/276 |
| 6,046,690 | * | 4/2000 | Evans, III | 340/999 |

* cited by examiner

*Primary Examiner*—Brent A. Swarthout

(57) ABSTRACT

A national wave event is provided by the application of light and sound in a controlled manner along an extended plane whereby the time duration and application of the light and sound is visually and acoustically recorded and transmitted from a predetermined distance. Automobile headlights and horns are activated for a brief time period along a directed path within a plurality of selected states to provide the wave transfer indication.

10 Claims, 1 Drawing Sheet

WAVE TRANSFER TEACHING AID AND NATIONAL WAVE TRANSFER DEVICE (RAG-1)

BACKGROUND OF THE INVENTION

The science of wave transfer physics is often difficult to explain to those untrained in physics, particularly where the transfer medium remains in place as the waves travel therealong.

The concept of a so-called "sports wave", however, is easily understood. Most attendees of sports functions such as baseball and football games have participated in such a wave. Members of the audience stand and sit in a sequential manner along a usually clockwise, direction in a plane, taking their cues for action from direct observation of the approaching wave. This gives the appearance of wave-like motion.

The concept can be applied to large geometric extents, such as across the continental United States. However, it is difficult to coordinate and to view such a large number of persons standing and sitting, since the distance of the viewer must be substantially distant from the participants to view the overall effect.

The wave transfer function could be used to participate in a national event occurring across a large expanse such as the continental United States. One such event is the celebration of the Y2K phenomenom, signifying the turn of the century occuring on the last day of December of the year nineteen ninety nine. The wave could track the arrival of solar midnight and would take about four hours to traverse from Maine to California. Should such a wave be staged on a national or even on a city-wide basis, some means of indicia must be employed to provide accurate optical and acoustical portrayal of the wave.

One example of an inter-active means for teaching science is found in U.S. Pat. No. 5,813,865 entiled "Methods and Apparatus for Teaching Science and Engineering" wherein an inter-active multi-media computer system is used to simulate the performance of scientific experiments on a computer screen.

An earlier U.S. Pat. No. 5,526,479 entailed "Method and Apparatus for Broadcasting Live Events to Another Location and Producing a Computer Simulation of the Events at That Location" utilizes a computer-coded description of the sub-events that constitutes the event and stores the coded description in a centralized computer data base.

One purpose of the invention is to describe a simple arrangement whereby participants within a large area could create a two-dimensional plane wave, so-called "national wave" to co-celebrate an extrodinary event.

An additional purpose of the invention is to describe how such a wave can be generated and viewed by a large audience along with the requisite co-ordinationate timing of sound and light on a city-by-city basis.

A further purpose of the invention is to provide a teaching aid whereby students are able to visualize and comprehend the transfer of energy by the application of geometric wave physics as well as teaching the populace about the concept of wave generation.

SUMMARY OF THE INVENTION

A national wave is provided by the application of light and sound in a controlled manner along an extended plane. The wavefront propagation and the wavelength is controlled by time duration and the application of light and sound. The light and sound is seen and heard locally, by the participants, and when recorded from appropriate viewing stations, the wave is viewed globally as it propagates over an extended distance. One means of light and sound generation is by use of automobile headlights and automobile horns.

DESCRIPTION OF THE PREFERRED EMBODIMENT

Before providing indication of the so-called "national wave" according to the invention, it is helpful to describe the means of generating the light and sound used to initiate and record the wave transfer phenomena. The selected state would involve forty cities and twenty neighborhoods per city would be selected in a parallel array. The time of transfer across the selected States is determined and a central controller then signals the initiating state participants to commence turning on the headlights and beeping the horns of their respective automobiles for a specified time period. The next group of particants are then advised to turn on their lights and sound their horns for the same time period, until the entire group in the State has completed the sequence. The wave transfer is televised or video-recorded from a sufficient vertical distance to appear as a burst of light in digital format.

The concept is described as a means to greet the new Millennium on the evening of Dec. 31, 1999. In an extraordinary coincidence of nature, sound travels at just about the same speed that solar midnight passes over the earth at a Latitude of about 45 degrees, which is the approximate Latitude of Bangor, Maine and Portland, Oreg. Thus, if a participant sounds a horn upon hearing a horn emanating from the East, this action will create a sound wave which tracks the arrival of solar midnight, from East to West.

If, in addition, the participant turns on the headlight of a car for about 60 seconds, this will create a wave of light, about 12 miles wide. Thus a wave of light and sound will greet the new millennium. Because the speed of sound is greatly variable and because the solar speed varies with Latitude—it is about 1000 feet per second at 45 degrees North Latitude and about 1250 feet per second at 30 degrees North in Florida, the wave must be continuously adjusted to track the arrival of the millennium. The wave adjustment and the ways to simulate the effect on a computer allow the citizens to see and understand the nature of such a wave, even if the physical wave is undertaken only in selected cities or not at all.

For transfer of the national wave from East to West, for example, a linear path which follows a line of Longitude is selected and a number of participants thereof are given instructions as to when to switch on automobile head lights and to operate automobile horns, for example. The instructions can be organized by "unit", for example by town, cities, or zip codes. Key participants in each unit are instructed when to initiate the wave within the unit. This will ensure that the wave is synchronized in accordance with the particular purpose of the wave and the within the intended "area", such as the continental United States, as will be described below in greater detail. Satellite, airplane, blimp, and high-tower video cameras would be used to view and record the event.

Figure 1:
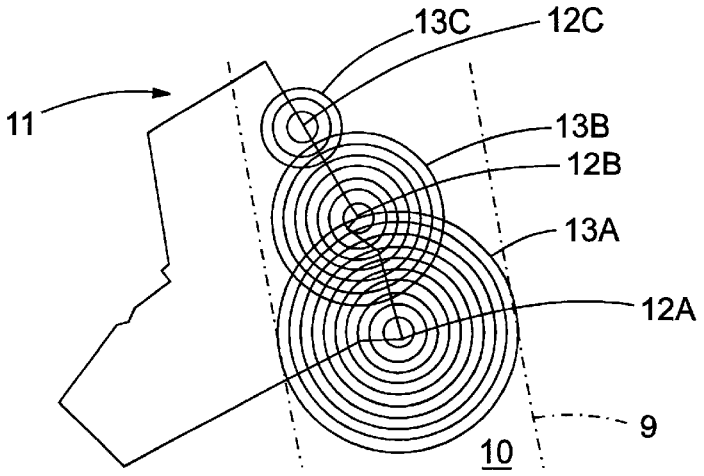
FIG. 1 is a front plan view of a map of the city of Woburn Mass. depicting the wave transfer from the eastern part to the western part of the city.

FIG. 1 shows a wave transfer depiction 10 within the map 11 of Woburn, a city in Massachusetts. It shows how the waves 13(A–E) of light and sound is initiated. The waves 13(A–C) are generated at one-second intervals from three initiation points 12(A–C) Woburn is located at approximately 42.5 degrees North Latitude and 71.2 degrees West Longitude. The Latitude line at 42.5 degrees N is 24,893*cosine(42.5 degrees)=18,353 miles long, where the earth's circumference is approximately 24,893. The calculations are approximate because the earth is slightly elliptical with the eccentricity being small compared to the calculations. For example, in one day, solar midnight passes along the 42.5 degree latitude line at 18,353/(24*60*60)= 0.214 miles per second, where there is 24*60*60 second in a day. The speed of sound varies greatly with temperature, pressure and wind velocity, but a speed useful for the general public in 5 seconds per mile. This is the measure used by parents to show their children that if they count to five between the flash of lightning and the sound of thunder, then the lightning is one mile away. The commonly used speed of sound, namely 0.2 miles per second, is very close to the speed of solar midnight, in Woburn. Point 12A of FIG. 1 is the Eastern-most point in the city, ie East Woburn. It is at Longitude 71 degrees, 28 minutes and 25.91 seconds, West, which translates into 72+28/60+25.91/(60*60)=71.1125 degrees West Longitude. Thus Solar midnight occurs in East Woburn at 71.1125*24*60*60/360=17,067 seconds after it passes over 0 degrees Longitude, in England.

Woburn is in the Eastern Standard Time Zone, EST, which is 5 time zones removed from England. Thus EST midnight is 5*60*60=18,000 seconds after midnight in England. From these calculations solar midnight at point 12A is found to occur 18,000–17,067=933 seconds or 15 minutes and 33 seconds before EST midnight. The time to initiate the wave at point 12A is at 11:44:27 pm. For the known Longitude at points 12A and 12B, the launch times for points 12A and 12B are calculated for 11:44:29 pm and 11:44:33 pm respectively. The wave at point 12B is launched two seconds after that at point 12A, and the wave point 12C is launched 6 seconds after that at point 12A.

The wave is launched initially by sounding a horn for few seconds and by turning on a headlight or other light for about a minute. When a subsequent participant hears the horn, he or she sounds their horn and turns on their light to produce the complete wave, in digital format. Other sources of electromagnetic energy such as an infrared source could be used to produce the light and other sources of acoustic energy such as sirens could also be used to produce the sound, depending on climatic conditions.

The wave transfer geometry 10 is depicted within the map 11 of the city of Woburn in FIG. 1 ten seconds after the start of the wave 13A at point 12A. There are ten composite waves 13A radiating from point 12A, seven composite waves 13B radiating from point 12B; and three composite waves 13C radiating from point 12C. The wave front 9, indicated in phantom, is the Western-most extent of the combined 13(A–C). As described earlier, there should be many, many sources of sound and light, one for each participant, and initiated by the arrival of the sound (not the light) wave. The wave front 9 will become more planer as the other participants contribute light and sound. The wave will start at the Eastern-most point of Woburn and about 23 seconds later will arrive in Western-most point of Woburn, which is indicated at point 12E in FIG. 1. Point 12D is at the top of a local Mountain, which would be a good viewing point for the Woburn wave, as well as for the wave front 9 as it proceeds from Woburn to the neighboring cities to the west thereof.

Figure 2:
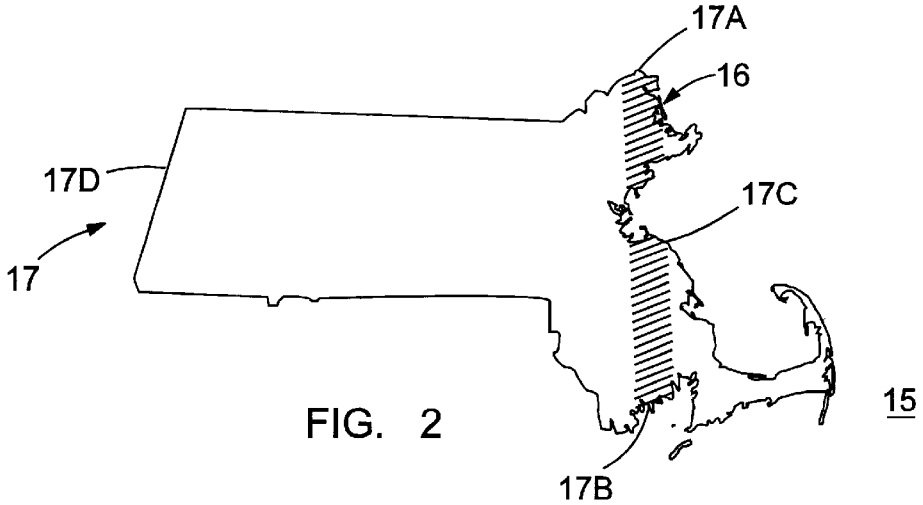
FIG. 2 is a front plan view of the map of the state of Massachussetts depicting the transfer of the wave from the eastern part of the western part of the state.

The wave transfer geometry 15 with the map 17 of the State of Massachussetts is depicted in FIG. 2 with the wave train 16 extending from the northernmost part 17A of the State to the southernmost part 17B. When the participants turn on their lights for 60 seconds, the wave train 16 will be about 60/12=5 miles wide with the width being controlled by the length of time the lights are on. The time that the lights are on can be modulated to display a variety of wave train patterns, such as an oscillating wave train, for example. The color of the lights can be different if a specified color pattern is desired. The wave train 16 of Fig. 2 takes about 14 minutes to pass from the easternmost part 17C of the state of Massachussetts 17 to the westernmost part 17D, thereof.

Figure 3:
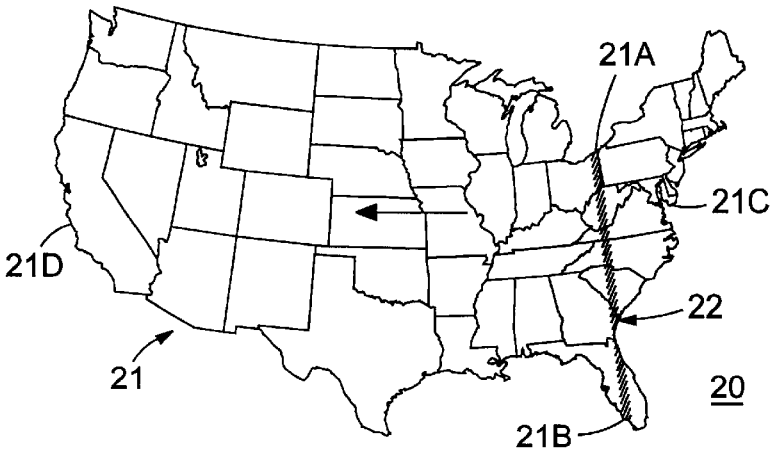
FIG. 3 is a front plan view of the map of the United States depicting the wave as it transfers from the East Coast to the West Coast thereof.

The wave transfer geometry 20 within the map 21 of the United States is depicted in FIG. 3 with the wave train 22 extending from the northernmost part 21A of the United States to the southernmost part 21B. The wave train 22 proceeds from the East Coast 21C to the West Coast 21D, as indicated. As described earlier, the width of the wave train 22 can be modulated to facilitate viewing from various platforms throughout the United States.

As described earlier, a television satellite receiver would be focused on the participating states to continuously view and record the light and sound occurance for televising such through out the Nation over the required time frame to complete the national wave transfer.

What is claimed is:

1. A national wave indication comprising:

a first plurality of lights arranged in a first particular location, said first lights then being turned on for a first predetermined period of time;

a second plurality of lights at a second particular location apart from said first location, said second lights being turned on for a second predetermined period of time subsequent to said first predetermined period;

means arranged at a predetermined distance from said first and second lights to record and display said first and second lights in a wave transfer format;

a multiple plurality of lights subsequent to said first and second lights, said multiple plurality being displaced from said first and second locations; and a first plurality of horns located at said first particular location, said first horns being actuated for said first predetermined time period.

2. The wave indication of claim 1 including a second plurality of horns located at said second particular location, said second horns being actuated for said second predetermined time period.

3. The wave indication of claim 1 wherein said first lights comprise automobile headlights or other sources of electromagnetic energy.

4. The wave indication of claim 1 wherein said first horns comprise automobile horns or other sources of acoustic energy.

5. The wave indication of claim 1 further including means to modulate said wave by varying said first predetermined time.

6. The wave indication of claim 1 wherein said light comprises a first color.

7. The wave indication of claim 6 wherein said light comprises a second color different from said first color.

8. A method for generating a visual waveform comprising the steps of arranging a first plurality of lights and a first plurality of horns in a first particular location; turning on said first lights and actuating said first horns for a first predetermined period of time; arranging a second plurality of lights and a second plurality of horns at a second particular location apart from said first location;

turning on said second lights and actuating said second horns for a second predetermined period of time subsequent to said first predetermined time period; and providing means at a predetermined distance from said first and second lights to record and display said first and second lights in a wave transfer format, said first plurality of horns comprising automobile horns.

9. The method of claim 8 including the steps of: providing a multiple plurality of lights subsequent to said first and second lights, said multiple plurality being displaced from said first and second locations.

10. The method claim 8 wherein said first plurality of lights comprise automobile headlights or other sources of electromagnetic energy.

* * * * *